US010479571B2

(12) United States Patent
Lanagan et al.

(10) Patent No.: US 10,479,571 B2
(45) Date of Patent: Nov. 19, 2019

(54) DIFFUSING DEVICE

(71) Applicants: David Robert Lanagan, Cheshire (GB); Michael John Owen, Cheshire (GB)

(72) Inventors: David Robert Lanagan, Cheshire (GB); Michael John Owen, Cheshire (GB)

( * ) Notice: Subject to any disclaimer, the term of this patent is extended or adjusted under 35 U.S.C. 154(b) by 61 days.

(21) Appl. No.: 15/554,770

(22) PCT Filed: Mar. 1, 2016

(86) PCT No.: PCT/GB2016/050529
§ 371 (c)(1),
(2) Date: Aug. 31, 2017

(87) PCT Pub. No.: WO2016/139459
PCT Pub. Date: Sep. 9, 2016

(65) Prior Publication Data

US 2018/0016069 A1 Jan. 18, 2018

(30) Foreign Application Priority Data

Mar. 2, 2015 (GB) ..... 1503477

(51) Int. Cl.
*B65D 51/28* (2006.01)
*B01F 15/02* (2006.01)
*B01F 1/00* (2006.01)

(52) U.S. Cl.
CPC ..... *B65D 51/2885* (2013.01); *B01F 1/0016* (2013.01); *B01F 15/0224* (2013.01)

(58) Field of Classification Search
CPC . B65D 51/2885; B65D 85/804; B01F 1/0016; B01F 3/00; B01F 5/00; B01F 15/0224
USPC ..... 220/522; 215/DIG. 8, 258, 17, 227, 250, 215/294, 21; 222/566, 569, 548, 549, 222/562, 541.1, 534; 206/221, 219
See application file for complete search history.

(56) References Cited

U.S. PATENT DOCUMENTS 520,219 A * 5/1894 Rand ..... B65D 49/04 215/21
599,156 A 2/1898 Thompson
707,759 A * 8/1902 Burns ..... B65D 55/02 215/250

(Continued)

FOREIGN PATENT DOCUMENTS

EP 0 050 906 A1 5/1982
FR 2 153 767 A5 5/1973
FR 2 949 303 A1 3/2011

OTHER PUBLICATIONS

International Search Report and Written Opinion for corresponding Patent Application No. PCT/GB2016/050529 dated Jul. 1, 2016.

*Primary Examiner* — Chun Hoi Cheung
*Assistant Examiner* — Brijesh V. Patel
(74) *Attorney, Agent, or Firm* — Renner, Otto, Boisselle & Sklar, LLP

(57) ABSTRACT

The present invention relates to a capsule (11) for diffusing a substance in a liquid within a receptacle (50). The capsule comprises an expandable element and, in a first state the capsule has a first width and in a second state the capsule has a second width. The width of the capsule in the second state is greater than that of the first state.

16 Claims, 3 Drawing Sheets

(56) References Cited

U.S. PATENT DOCUMENTS 908,822 A * 1/1909 Turner ..... B65D 41/3442 215/258
978,712 A * 12/1910 Drenk ..... B65D 55/02 215/250
2,032,478 A * 3/1936 Haase ..... B65D 39/12 215/294
2,781,141 A * 2/1957 Lucien ..... B65D 51/2885 206/221
3,129,854 A * 4/1964 Boehm ..... B05B 11/0013 215/358
3,326,400 A * 6/1967 Hamelin ..... B65D 51/2871 206/221
3,924,741 A * 12/1975 Kachur ..... B65D 51/2892 206/221
4,193,698 A * 3/1980 Gartner ..... B01F 7/0005 206/219
4,195,730 A * 4/1980 Hunt ..... B65D 51/2814 206/221
4,203,517 A * 5/1980 Hildebrandt ..... B65D 51/2871 206/221
4,315,570 A * 2/1982 Silver ..... B65D 81/3222 206/221
4,386,696 A 6/1983 Goncalves
4,865,189 A * 9/1989 Guerra ..... B65D 51/28 206/221
5,586,589 A * 12/1996 Voelker ..... B65D 81/3222 206/221
5,788,369 A 8/1998 Tseng
5,950,819 A * 9/1999 Sellars ..... B65D 51/2871 206/221
6,170,654 B1 * 1/2001 Gartner ..... B65D 51/2814 206/221
6,357,614 B1 * 3/2002 Kerr ..... B65D 49/04 215/21
6,921,087 B2 * 7/2005 Takahashi ..... B65D 39/12 215/294
7,210,575 B2 * 5/2007 Oswald ..... B65D 41/3442 215/258
8,215,505 B2 * 7/2012 Lee ..... B65D 41/04 53/471
8,418,423 B1 4/2013 Potts et al.
8,544,690 B2 * 10/2013 Garcia ..... B65D 51/2835 222/81
8,672,156 B2 * 3/2014 Martinovic ..... B65D 51/2892 206/221
8,720,680 B2 * 5/2014 Casey ..... A47J 47/10 53/408
2003/0222102 A1 * 12/2003 Cho ..... B05B 11/0013 215/358
2005/0211655 A1 * 9/2005 Bourreau ..... B65D 55/02 215/250
2008/0023349 A1 * 1/2008 Balazik ..... B65D 51/28 206/222
2010/0108715 A1 * 5/2010 Santagiuliana .... B65D 51/2835 222/81
2012/0124942 A1 * 5/2012 Shani ..... A47J 47/10 53/408
2014/0076933 A1 3/2014 Chisholm
2014/0237949 A1 * 8/2014 Bryant ..... B65D 41/04 53/471

* cited by examiner

DIFFUSING DEVICE

This application is a national phase of International Application No. PCT/GB2016/050529 filed Mar. 1, 2016 and published in the English language, which claims priority to United Kingdom Patent Application No. 1503477.0 filed Mar. 2, 2015, which are hereby incorporated herein by reference.

FIELD OF THE INVENTION

The invention relates to a device for diffusing a substance into a liquid contained within a receptacle, particularly a receptacle with a narrow opening, such as a bottle.

BACKGROUND TO THE INVENTION

There is a desire to disperse, diffuse and/or dissolve substances in liquids and this may be particularly desirable with liquids contained in bottles. Although dissolvable items may be dropped into a bottle containing liquid, for example, a bottle of water, in some circumstances, the substance can degrade over time. Therefore, there is a desire to dissolve the substance just before use or consumption. Additionally, some substances are used to impart a flavour to a liquid rather than dissolving itself in the liquid. However, where the substance does not dissolve, it is desirable to prevent it being poured back out of the opening to the bottle, particularly, where a substance imparts a flavour and it is not desirable to consume the substance. Thus, there is a need to allow it to mix with the liquid but for the substance to remain in the bottle so that it is not consumed.

SUMMARY OF THE INVENTION

Accordingly, the present invention is directed to a capsule for diffusing a substance in a liquid within a receptacle, wherein the capsule comprises an expandable element and, in a first state the capsule has a first width and in a second state the capsule has a second width, wherein the width of the capsule in the second state is greater than that of the first state.

The capsule contains a substance that, when the capsule is put into a liquid, comes into contact with the substance. This allows the substance to be diffused and/or dispersed into the liquid. The capsule has means for expanding its diameter so that when it passes through an opening, it can expand beyond the diameter of the opening to prevent it coming back out. The capsule comprises a one way mechanism to allow it to enter into a receptacle, for example, a bottle, and to be retained therein whilst liquid is poured from the bottle.

The capsule has a first state, arrangement or position in which it can pass through an opening or aperture relatively easily, and a second state, arrangement or position in which the diameter is increased to make passage through the opening or aperture more difficult or impossible.

In one embodiment, the expandable element comprises a material that expands upon contact with liquid. This might be a hydro-expandable material that expands significantly upon contacting liquid to swell. It may expand upon contact with water or another liquid. When the capsule is dropped into a bottle through the opening, and the expandable material has expanded, the diameter of the capsule is then too large for the capsule to pass back through the opening.

Preferably, the expandable material is arranged about the periphery of the capsule and, more preferably, the expandable material is arranged as a continuous band about the periphery of the capsule. The expandable material may be arranged radially around the capsule and/or it may be continuous or discrete portions arranged on the capsule.

In an alternative embodiment, the capsule comprises at least one resilient section that extends beyond the periphery of the capsule when the capsule is in the second state. The resilient section provides a plastically deformable, or resiliently yieldable, portion that can be deformed in a first state to reduce the diameter of the capsule, and then it may expand upon releasing the deforming force to allow it to increase the diameter of the capsule.

It is advantageous that the resilient section comprises a resilient protrusion that, in the first state, is compressed and in the second state is released. Such an arrangement allows for the internal surfaces of an opening to compress the resilient protrusion as the capsule passes through the opening and for the resilient protrusion to return to its expanded state once the capsule has passed through the opening and no further force acts upon the section.

It is preferable that the resilient section comprises an arm, which, in the second state, forms a barb. By employing an arm, which may be formed from resilient material or may be hinged with a bias towards a position with one end directed away from the capsule, a barb can be formed that allows the arm to yield as the capsule passes through an opening. The arm then returns to the extended position in the second state of the capsule and the barb reduces the risk of the capsule coming back through the opening.

It is preferable that the resilient section comprises an elastically deformable plastics material. Plastics material provides a cost-effective and elastically deformable material that will form an expandable section.

Advantageously, the capsule further comprises an inner chamber with at least one aperture therein. The chamber allows for a substance, which may be a solid, liquid or a gas, to be released into liquid contained within a receptacle when the capsule is inserted therein. A solid may be contained within the capsule that will impart flavour, nutrients, electrolytes or other properties into the liquid. The solid may or may not dissolve into the liquid and, where it does not dissolve, it can be retained within the capsule.

Preferably, the capsule comprises a plurality of apertures/perforations. The use of a plurality of apertures and/or perforations allows for the liquid within the receptacle to mix more readily and more rapidly with the contents of the capsule, once the capsule has been inserted into the receptacle.

In an advantageous construction, the capsule comprises a weighted section. Using a weighted section in the capsule reduces the risk of the capsule becoming stuck in the neck of a bottle and also reduces the risk of the capsule floating in the liquid contained within the receptacle, thus allowing the substance to contact the liquid more readily.

The invention extends to a diffusing device comprising a carriage and a detachable capsule according to any preceding claim, wherein respective parts of a releasable connection mechanism are provided on the carriage and the capsule. A carriage being provided for the capsule can assist with the packing and dispensing of the capsule. For example, the carriage may be provided with locating means to attach it to the opening of a bottle, which automatically aligns the capsule with the bottle opening. Additionally, the top of the capsule may be open and the carriage may provide a lid to keep the contents within the capsule until it is dispensed into the receptacle.

In such an arrangement, the connection mechanism may comprise a threaded section, in which case it may be preferable that each of the carriage and the capsule are provided with a release protrusion, wherein the release protrusions are arranged such that when the carriage and capsule are rotated relative to one another, the protrusions abut one another. Having threaded sections to attach the capsule to the carriage provides a simple and readily releasable connection to keep the parts together. The release protrusions assist with holding the carriage and the capsule stationary relative to one another such that the threaded section engages and releases the capsule.

Alternatively, the capsule may comprise a lip about at least part of its perimeter at the intended top of the capsule and the carriage comprises a clip mechanism arranged to engage the lip of the capsule and retain it thereupon. The lip may be radial and/or axial. By clipping the capsule to the carriage, the parts can be quickly and easily engaged and disengaged from one another, thereby making the arrangement simple to use.

Advantageously, the clip mechanism of the carriage is attached internally to the intended upper surface of the carriage and it comprises two spaced apart extensions each having at least one inwardly protruding tooth, and wherein the upper surface between the two spaced apart extensions is resiliently flexible. By having a resilient material between the two parts of the clip mechanism, the distance between the two parts can be increased by pressing on the resilient section. This bends the resilient material, flexing the upper surface and increasing the distance between the two parts of the clip mechanism. The two parts then disengage the lip portion of the capsule.

The invention extends to a bottle comprising a receptacle and an opening to which is connected a diffusing device substantially as described herein.

The invention further extends to a method of bringing two substances into contact, wherein the method comprises the steps of:

providing a receptacle having an opening;

providing a capsule as described herein, the capsule having a substance therein;

inserting the capsule into the receptacle; wherein when the capsule has passed through the opening of the receptacle, at least one dimension of the capsule increases such that it becomes larger than the width, or diameter, of the opening of the receptacle.

The method provides for a way to mix two substances together within a receptacle, wherein the capsule enters the receptacle and cannot be readily removed therefrom due to the increase in the overall size of the capsule upon entering the receptacle.

Advantageously, the method comprises the use of a diffusing device as described herein to hold the capsule, and the further step of operating the diffusing device to detach the capsule from the carriage into the receptacle. The use of a carriage, assists in the accurate dispensing of the cartridge into the opening of the receptacle and may also assist with transporting the capsule.

Preferably, the receptacle contains a liquid prior to entry of the capsule therein, or alternatively, liquid may enter the receptacle after the capsule has been inserted. The point at which liquid is added to the receptacle may vary depending upon the products to be mixed/diffused and/or the circumstances of use of the capsule.

BRIEF DESCRIPTION OF THE DRAWINGS

An embodiment of the invention will now be described, by way of example only, and with reference to the accompanying drawings, in which.

DETAILED DESCRIPTION OF EXEMPLARY EMBODIMENTS

Figure 1:
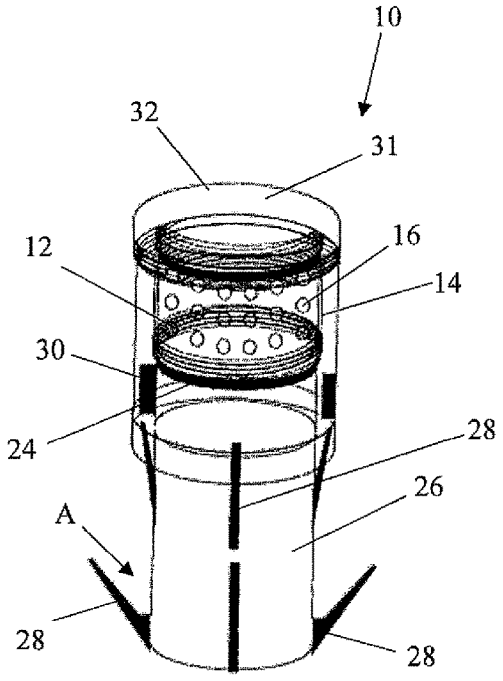
FIG. 1 is a drawing showing an embodiment of the present invention.
Figure 2:
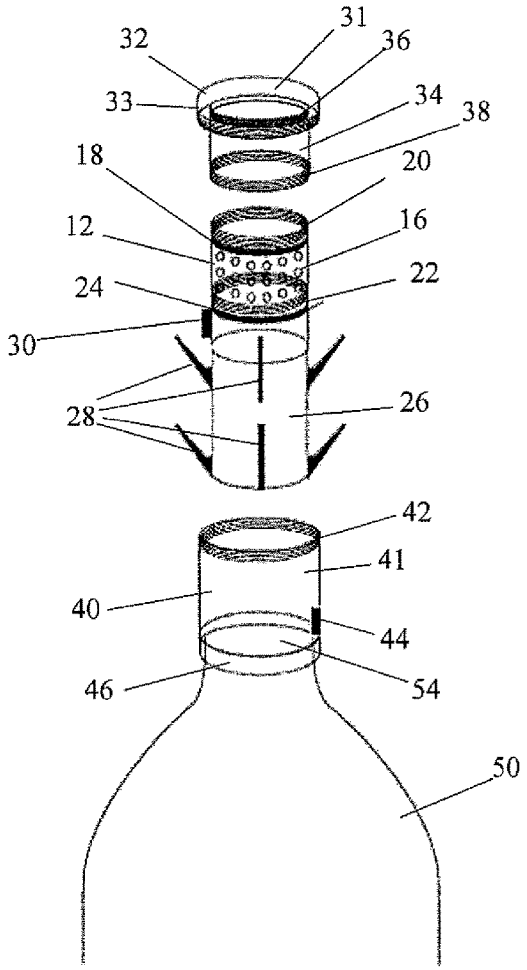
FIG. 2 is a drawing showing a further view of the embodiment of FIG. 1.
Figure 3:
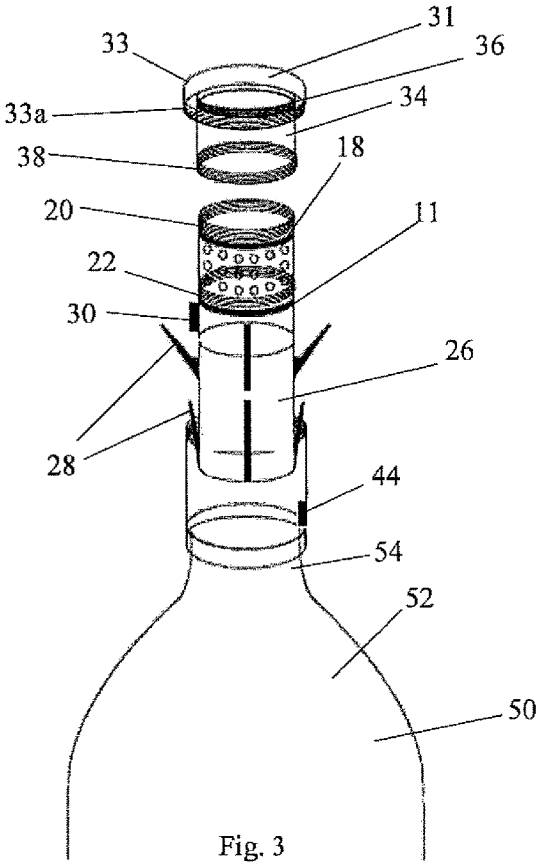
FIG. 3 is a drawing showing another view of the embodiment of FIG. 1.
Figure 4:
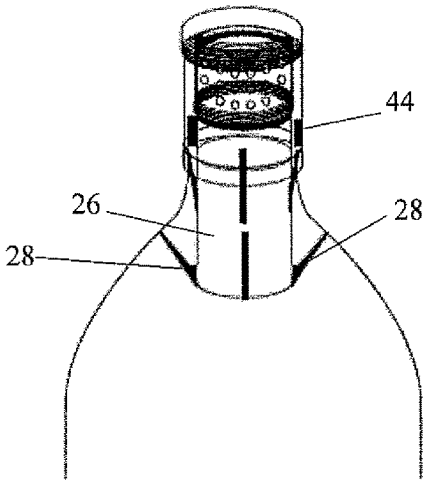
FIG. 4 is a drawing showing a further view of the embodiment of FIG. 1.

FIGS. 1 to 4 show a device 10 for diffusing, dispersing or dissolving a first substance into a liquid that is contained within a receptacle. The device 10 comprises a capsule 11 having a substance chamber 12 having a wall 14, in which are provided apertures 16 across a latitudinal band. Above the band of apertures is a band of expandable material 18 and above the band 18 is an upper threaded section 20. Below the band of apertures 16 is a lower threaded section 22 and beneath the lower threaded section 22 is an elastomeric O-ring seal 24.

The chamber 12 is integrally connected to a hollow base portion 26 such that the inside of the base portion is in fluid communication with the chamber 12. At the junction between the chamber 12 and the base portion 26 is an integral radially outwardly extending release tooth, or release protrusion, 30.

The base portion 26 comprises a plurality of spaced apart, radially extending, resilient plastics material arms 28 that each have a connecting section 28*a* and an angled extension 28*b*. There are two rows of arms 28, which may in in-line with one another or the rows may be rotationally offset. The arms 28 extend from the external surface of the base portion 26 in a generally upwards direction (towards the chamber 12) and diverge from the wall of the base portion 26, thereby creating an internal angle is between the external wall of the base portion 26 and the inside of the arm 28. The internal angle, A, may be between 15 and 85 degrees, but is preferably, between 25 and 60 degrees.

A carriage, or lid portion, 31 is provided. The carriage comprises a top portion 32 and a receiving section 34 integrally connected thereto and extending downwardly therefrom. The top portion comprises a downwardly extending lip 33 at its periphery, which is provided with a thread 33*a* on its internal surface. The receiving section 34 has a diameter larger than that of the substance chamber 12 and it is provided with an internal upper threaded portion 36 arranged proximal to the junction between the top portion 32 and the receiving section 34, and an internal lower threaded portion 38 distal from the top portion 32 and adjacent the end of the receiving section 34.

A connector 40 is also provided, which comprises a tubular collar, or connector, 41 having an external threaded section 42 adjacent the upper end of the tubular collar 41, and a reinforced rim 46 at its lower end. Within the tubular collar 41 is a second release tooth 44 extending radially inwardly.

To use the device 10, a substance is put into the chamber 12 and it passes into the inside of the base portion 26. The lid portion 31 is then positioned over the top of the chamber 12 and the internal lower threaded portion 38 of the lid 31 engages the lower threaded section 22 of the chamber 12. Likewise, the upper internal threaded section 36 of the lid 31, engages the external threaded portion 20 of the chamber 12. The base portion 26 is then held still as the lid portion 31 is rotated to fully engage the two interlocking threaded sections. Because the lid portion has the receiving section 34 that surrounds the chamber 12, the chamber 12 is held within the receiving section 34 upon tightening of the threaded sections. Additionally, due to the O-ring seal 24, the substance is held within the chamber 12 and lid section 31 and it cannot leak therefrom.

Where the substance is a liquid the expandable material band 18 may be replaced with a second elastomeric O-ring seal.

To dispense the capsule 11, a bottle 50 is provided, which comprises a main receptacle section 52 and an opening 54, which has a narrower diameter than that of the main receptacle 52. The connector 40 is positioned over the opening 54 of the bottle 50 and is held in place. The capsule 11 is placed into the top of the connector 40 and the internal threads 33*a* of the lip 33*a* of the lid section 31 engage the external threads 42 of the connector 40. The top section 31 is then rotated and the external release tooth 30 of the chamber 12 rotates until it contacts the second internally facing release tooth 44 of the connector 40. Upon the two release teeth 30 and 40 contacting, the internal lower threaded portion 38 and the lower threaded section 22 and the upper internal threaded section 36 and the external release tooth 30, rotate relative to one another and disengage.

The capsule 11 is now free from the lid 31 and, due to its weight, it passes through the opening 54 of the bottle 50. As the capsule 11 moves into the opening 54, the arms 28 are compressed and yield to allow the capsule to descend into the bottle 50. As the capsule 11 enters the main receptacle 52 of the bottle 50, the arms, being plastically resilient, expand and extend once more and form barbs. As a result, the overall diameter of the capsule is increased to the extent that it is too large to pass back through the opening 54 of the bottle 50. The capsule falls into the main receptacle 52 of the bottle 50 the substance contained within the capsule is able to mix with liquid within the bottle 50 to be diffused/dispersed/dissolved therein via the apertures 16.

Figure 5:
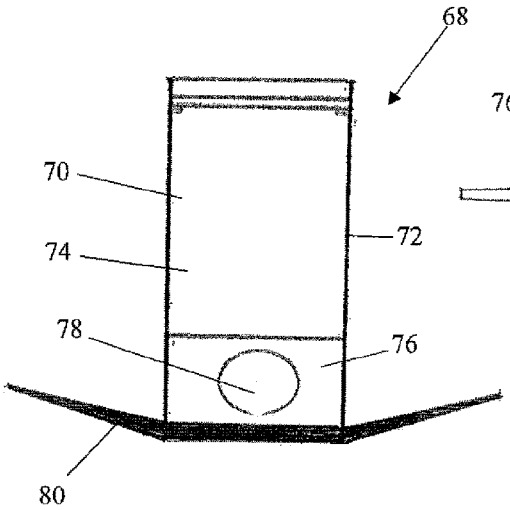
FIG. 5 is a drawing showing a second embodiment of the present invention.
Figure 5A:
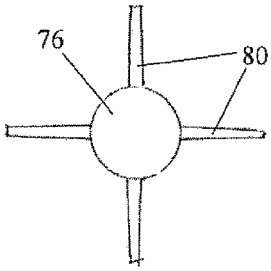
FIG. 5*a* is a drawing showing a bottom view of the device of FIG. 5.
Figure 6:
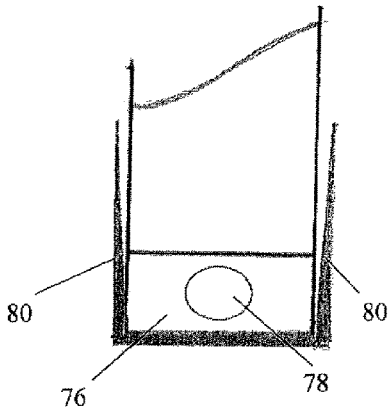
FIG. 6 is a drawing showing a further view of the device of FIG. 5.
Figure 7:
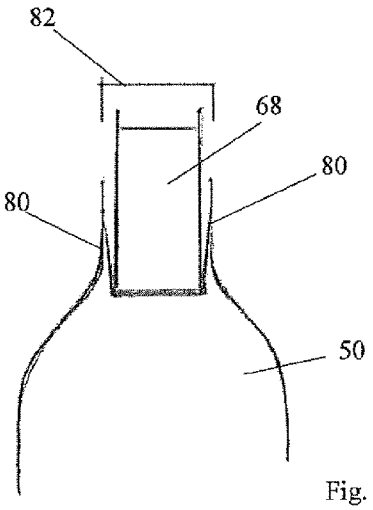
FIG. 7 is a drawing showing the device of FIG. 5, in use.

The capsule dispensing device 68 of FIGS. 5 to 8 comprises a capsule 70 having body portion 72 having an inner chamber 74. The base 76 of the body portion 72 comprises a weight 78 to increase the mass of the device 70. The base 76 comprises radially extending, resiliently yieldable, plastics material arms 80 that have a compressed position against the side of the body portion 72, as shown in FIG. 6, and an extended, rest, position wherein the project radially outwards from the base 76, as shown in FIGS. 5 and 5*a*.

A lid, or carriage, 82 is provided that connects to the top of the capsule 70. The lid is slightly larger than the opening in the bottle for which it is intended. The connection means between the capsule 70 and the carriage 82 are shown in Figures to 13.

Figure 9:
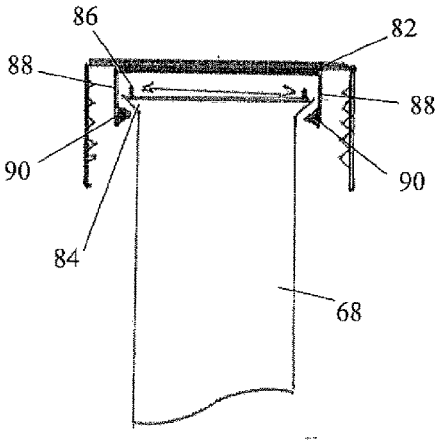
FIG. 9 is a drawing showing a third embodiment of the present invention.
Figure 8:
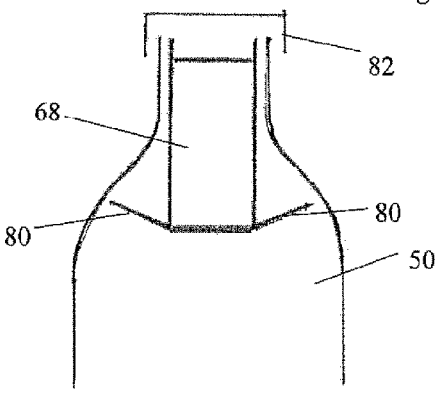
FIG. 8 is a drawing showing another view of the device of FIG. 5, in use.
Figure 10:
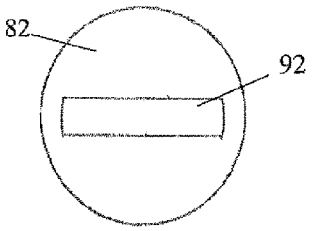
FIG. 10 is a drawing showing a top view of the device of FIG. 9.
Figure 11:
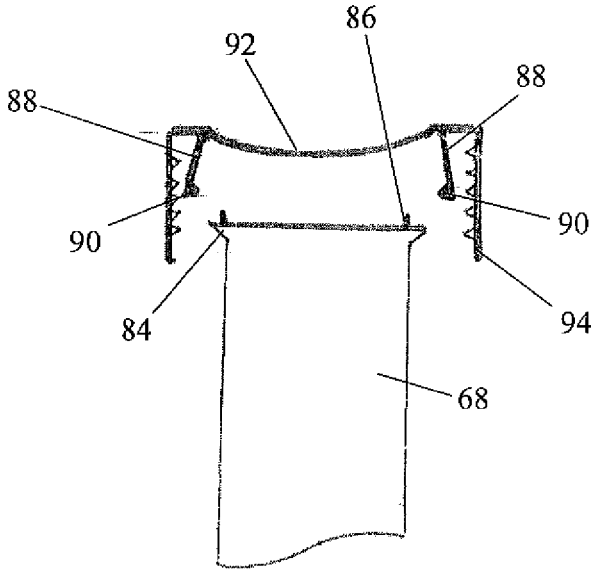
FIG. 11 is a drawing showing a further view of the device of FIG. 9.

FIGS. 9 to 11 show a first connection mechanism for releasably connecting the capsule 70 to the lid 82. The capsule 70 comprises a radially extending lip 84 with an elastomeric coating 86 on its upper surface. The lid 82 comprises two downwardly protruding extension 88, each provided with an inwardly directed wedge-shaped tooth 90. The extensions 88 are separated on the lid by a yieldable section 92. In a first position, the teeth 90 engage the lip 84 of the capsule 70. Because the teeth 90 are angled, as they are forced inwards by the resilient nature of the plastics material from which they are formed, the capsule 70 is directed into the lid 82. The elastomeric seal 86 seals the capsule against the lid 82.

When the capsule 70 is to be release from the lid 82, the resilient section 92 is pressed. Due to the flexible nature of the resilient section 92, it flexes and the underside of the lid 82 bends to become convex. This pushes the two extensions 88 and respective teeth 90 apart and the teeth 90 disengage from the lip 84 of the capsule 70. As such, the capsule 70 is dispensed from the lid 82 and can enter a receptacle.

The lid 82 may be provided with an outer rim 94 with internal threads, which can engage a bottle, for example, a water bottle, and can be held in place until the capsule 70 is dispensed. The lid 82 can then be removed from the bottle and liquid contained therein can be dispensed. Because the arms 80 flex out to create bards, the capsule 70 cannot come back through the opening without mechanical intervention.

Clearly, the elastomeric material 86 could be attached to the lid 82 rather than to the capsule 70.

Figure 12:
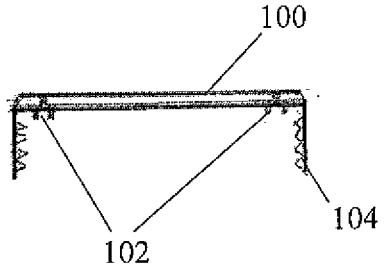
FIG. 12 is a drawing showing a fourth embodiment of the present invention.
Figure 13:
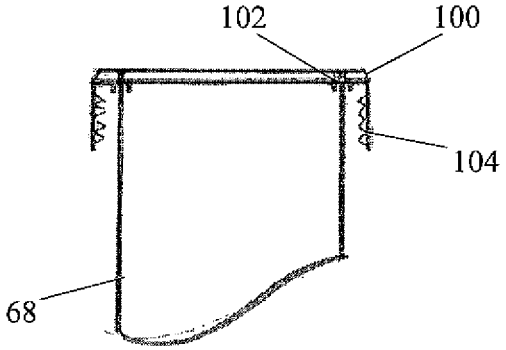
FIG. 13 is a drawing showing a further view of the device of FIG. 12.
Figure 14:
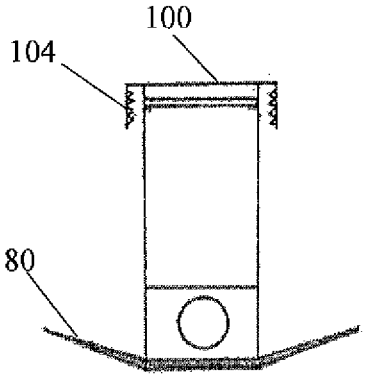
FIG. 14 is a drawing showing another view of the device of FIG. 13.

In FIGS. 12 to 14 a second connection mechanism is shown, wherein the lid 100 is provided with a channel of gripping material 102 on its underside, which preferably comprises elastomeric material. The upper surface of the capsule 70 is pushed into the channel and the gripping material 102 yields to accept the capsule 70 and it grips the capsule 70 and holds it in the lid 100. The capsule 70 can either be removed by pushing on yieldable material as shown in FIG. 11, or it may be either shaken off or the lid 100 may be removed to allow a user to manually remove the capsule 70 and insert it into the bottle. A skirt 104 with an internal thread is provided to allow the lid 100 to engage the threaded section of a bottle.

Figure 15:
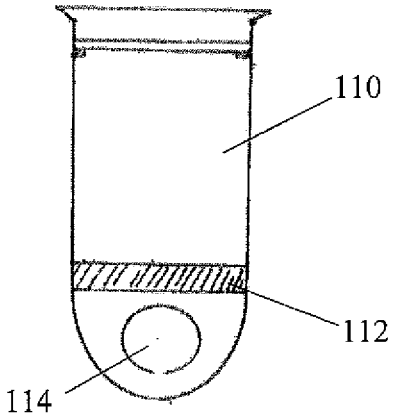
FIG. 15 is a drawing showing a fifth embodiment of the present invention.

FIG. 15 shows a further embodiment, wherein the capsule 110 is provided with a band of expandable material 112 and no resilient arms. Again, a weight 114 is provided in the capsule to reduce the risk of it becoming stuck in the opening of a bottle.

The substance chamber 12 may be tapered or may comprise a ledge, shelf or protrusion so that it is larger at the lower end than the upper end. This allows the threaded lid to fit around the upper threaded section and to engage the lower threads.

The base portion may comprise apertures and the substance may be contained therein, rather than in a separate chamber.

The connector may comprise a threaded section so that it can engage with the threads on a screw-top bottle. Alternatively, it may connect to the bottle by way of an elastomeric O-ring or other protrusion that aids in gripping the bottle.

The arms may be pivoted anus which are biased in an extended position but that are able to yield to allow the device to enter into the bottle.

The arms may be tapered to be wider at one end than the other. Such a wedge-shape helps the capsule enter the opening whilst making the capsule more difficult to remove from a receptacle.

Features and/or elements of any of the embodiments disclosed herein may be used in addition to, or in place of, features and/or elements of any of the other embodiments disclosed herein.

The present invention may be in the form of a capsule assembly for diffusing a substance in a liquid within a receptacle, wherein the assembly comprises a capsule and a carriage to which the capsule is releasably connected, wherein;

the capsule comprises an expandable element and, in a first state the capsule has a first width and in a second state the capsule has a second width;

wherein the width of the capsule in the second state is greater than that of the first state;

wherein the capsule is connected to the carriage via a releasable connection mechanism that comprises a threaded section and respective parts of a threaded section are provided on the carriage and the capsule; and wherein each of the carriage and the capsule are provided with a release protrusion and the release protrusions are arranged such that when the carriage and capsule are rotated relative to one another, the protrusions abut one another to enable the threaded sections to rotate and disengage.

Such a device may be used in the method described hereabove and may include other features described herein.

Features of one or more embodiment of the invention disclosed herein may be included in other embodiments herein disclosed. As such, where features are described in relation to one embodiment, they could, where practical, be included in other embodiments.

The invention claimed is:

1. A capsule assembly for diffusing a substance in a liquid within a receptacle, wherein the assembly comprises a capsule and a carriage to which the capsule is releasably connected, wherein:

the capsule comprises an expandable element and, in a first state the capsule has a first width and in a second state the capsule has a second width;

wherein the second width of the capsule in the second state is greater than that of the first state;

wherein the capsule is connected to the carriage via a releasable connection mechanism that comprises a threaded section and respective parts of the threaded section are provided on the carriage and the capsule; and wherein each of the carriage and the capsule are provided with a release protrusion and the release protrusions are arranged such that when the carriage and capsule are rotated relative to one another, the release protrusions abut one another to enable the threaded sections to rotate and disengage.

2. The capsule assembly according to claim 1, wherein the expandable element comprises a material that expands upon contact with liquid and wherein the expandable material is arranged about a periphery of the capsule.

3. The capsule assembly according to claim 1, wherein the capsule comprises at least one resilient section that extends beyond a periphery of the capsule when the capsule is in the second state.

4. The capsule assembly according to claim 3, wherein the resilient section comprises a resilient protrusion that, in the first state, is compressed and in the second state is released.

5. The capsule assembly according to claim 4, wherein the resilient section comprises an arm, which, in the second state, forms a barb.

6. The capsule assembly according to claim 3, wherein the resilient section comprises an elastically deformable plastic material.

7. The capsule assembly according to claim 1, wherein the capsule further comprises an inner chamber with at least one aperture therein.

8. The capsule assembly according to claim 1, wherein the capsule comprises a plurality of at least one of apertures and perforations.

9. The capsule assembly according to claim 1, wherein the capsule comprises a weighted section.

10. The capsule assembly according to claim 1, wherein the capsule comprises a lip about at least part of its perimeter at the intended top of the capsule and the carriage comprises a clip mechanism arranged to engage the lip of the capsule and retain it thereupon.

11. The capsule assembly according to claim 10, wherein the clip mechanism of the carriage is attached internally to the intended upper surface of the carriage and it comprises two spaced apart extensions each having at least one inwardly protruding tooth, and wherein the upper surface between the two spaced apart extensions is resiliently flexible.

12. A bottle comprising a receptacle and an opening to which is connected a capsule assembly according to claim 1.

13. A method of bringing two substances into contact, wherein the method comprises the steps of:

providing a receptacle having an opening;

providing a capsule assembly according to claim 1, the capsule assembly having a substance therein;

inserting the capsule into the receptacle; wherein when the capsule has passed through the opening of the receptacle, at least one dimension of the capsule increases such that the at least one dimension becomes larger than the width of the opening of the receptacle.

14. The method according to claim 13, wherein the method comprises the use of a diffusing device to hold the capsule, and the further step of operating the diffusing device to detach the capsule into the receptacle.

15. The method according to claim 13, wherein the receptacle contains a liquid.

16. The method according to claim 13, wherein a liquid is poured into the receptacle once the capsule is in the receptacle.

* * * * *